US010555068B2

(12) United States Patent
Christoph

(10) Patent No.: US 10,555,068 B2
(45) Date of Patent: Feb. 4, 2020

(54) ACTIVE HEADPHONES WITH POWER CONSUMPTION CONTROL

(71) Applicant: Harman Becker Automotive Systems GmbH, Karlsbad (DE)

(72) Inventor: Markus Christoph, Straubing (DE)

(73) Assignee: HARMAN BECKER AUTOMOTIVE SYSTEMS GMBH, Karlsbad (DE)

( * ) Notice: Subject to any disclaimer, the term of this patent is extended or adjusted under 35 U.S.C. 154(b) by 0 days.

(21) Appl. No.: 15/515,435

(22) PCT Filed: Sep. 10, 2015

(86) PCT No.: PCT/EP2015/070728

§ 371 (c)(1),
(2) Date: Mar. 29, 2017

(87) PCT Pub. No.: WO2016/050476

PCT Pub. Date: Apr. 7, 2016

(65) Prior Publication Data

US 2018/0234757 A1 Aug. 16, 2018

(30) Foreign Application Priority Data

Sep. 29, 2014 (EP) ..... 14186743

(51) Int. Cl.

| | |
|---|---|
| ***H04R 1/10*** | (2006.01) |
| ***G10K 11/16*** | (2006.01) |
| ***H04R 3/00*** | (2006.01) |

(52) U.S. Cl.
CPC ..... *H04R 1/1083* (2013.01); *G10K 11/16* (2013.01); *H04R 1/1041* (2013.01); *H04R 3/00* (2013.01);
(Continued)

(58) Field of Classification Search
None
See application file for complete search history.

(56) References Cited

U.S. PATENT DOCUMENTS

2004/0196992 A1* 10/2004 Ryan ..... H04R 1/10 381/312
2010/0020998 A1 1/2010 Brown et al.
(Continued)

FOREIGN PATENT DOCUMENTS

EP 1499017 A2 1/2005

*Primary Examiner* — James K Mooney
(74) *Attorney, Agent, or Firm* — Brooks Kushman P.C.

(57) ABSTRACT

Power consumption control of an active noise control headphone system that comprises headphones with at least one ear cup; at least one loudspeaker disposed in the at least one ear cup; at least one microphone disposed in or on the at least one ear cup that is configured to provide a microphone output signal representative of sound present in the ear cup; and at least one active noise control module that has at least two operating states and that is connected upstream of the at least one loudspeaker and downstream of the at least one microphone, wherein the microphone output signal at at least two different evaluation frequencies within the audible frequency range is evaluated to provide at least two evaluation output signals and the operating state of the at least one active noise control module is changed based on a comparison of the at least two evaluation output signals.

17 Claims, 5 Drawing Sheets

(52) U.S. Cl.
CPC .. *G10K 2210/1081* (2013.01); *H04R 2460/01* (2013.01); *H04R 2460/03* (2013.01)

(56) References Cited

U.S. PATENT DOCUMENTS

2014/0037096 A1* 2/2014 Duisters ..... H04R 29/00 381/58
2014/0037101 A1 2/2014 Murata et al.

* cited by examiner

ACTIVE HEADPHONES WITH POWER CONSUMPTION CONTROL

CROSS-REFERENCE TO RELATED APPLICATION

This application is the U.S. national phase of PCT Application No. PCT/EP2015/070728 filed on Sep. 10, 2015, which claims priority to European Patent Application No. 14186743.2 filed on Sep. 29, 2014, the disclosures of which are incorporated in their entirety by reference herein.

TECHNICAL FIELD

The disclosure relates to active headphones, in particular to active headphones with power consumption control.

BACKGROUND

Many portable consumer and professional audio devices utilize headphones in order to provide audio content to a user. The headphones typically include two earpieces that are worn over the ears of users and that are coupled to the stereo audio channels of an audio device. Alternatively, the two earpieces may share a single audio channel or need no audio channel at all, as in the case of noise-reducing headphones. Each earpiece includes an ear cup in which at least one loudspeaker (i.e., a sound-emitting transducer) is disposed. More and more active circuits that provide, for example, active noise control (ANC) or wireless signal transmission are also included in the earpieces (or may be carried separately) to form active headphones. Active headphones are often battery-powered and include an on-off switch to turn them on and off. One problem with battery-powered headphones, particularly those with automatic noise-reduction circuitry, concerns battery life. Users who have these headphones generally put on and take off their headphones many times, often forgetting to turn them off, thus wasting costly battery life. Moreover, for headphones that are used infrequently and that are stored for long times between uses, the turn-off problem is worse, not only because their batteries are more apt to die, but because charging the batteries or finding fresh batteries is too often inconvenient.

SUMMARY

An active noise control headphone system with power consumption control comprises the following; headphones with at least one ear cup; at least one loudspeaker disposed in the at least one ear cup; at least one microphone disposed in or on the at least one ear cup that is configured to provide a microphone output signal representative of sound present in the ear cup; and at least one active noise control module that has at least two operating states and that is connected upstream of the at least one loudspeaker and downstream of the at least one microphone. The active noise control headphone system further comprises an evaluation module that is configured to evaluate the microphone output signal at at least two different evaluation frequencies within the audible frequency range to provide at least two evaluation output signals and that is configured to change the operating state of the at least one active noise control module based on a comparison of the at least two evaluation output signals.

A method is configured to control the power consumption of an active noise control headphone system that comprises the following: headphones with at least one ear cup; at least one loudspeaker disposed in the at least one ear cup; at least one microphone disposed in or on the at least one ear cup that is configured to provide a microphone output signal representative of sound present in the ear cup; and at least one active noise control module that has at least two operating states and that is connected upstream of the at least one loudspeaker and downstream of the at least one microphone. The method comprises the following: evaluating the microphone output signal at at least two different evaluation frequencies within the audible frequency range to provide at least two evaluation output signals and changing the operating state of the at least one active noise control module based on a comparison of the at least two evaluation output signals.

Other systems, methods, features and advantages will be or will become apparent to one with skill in the art upon examination of the following detailed description and figures. It is intended that all such additional systems, methods, features and advantages be included within this description, be within the scope of the invention and be protected by the following claims.

BRIEF DESCRIPTION OF THE DRAWINGS

The system may be better understood with reference to the following description and drawings. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
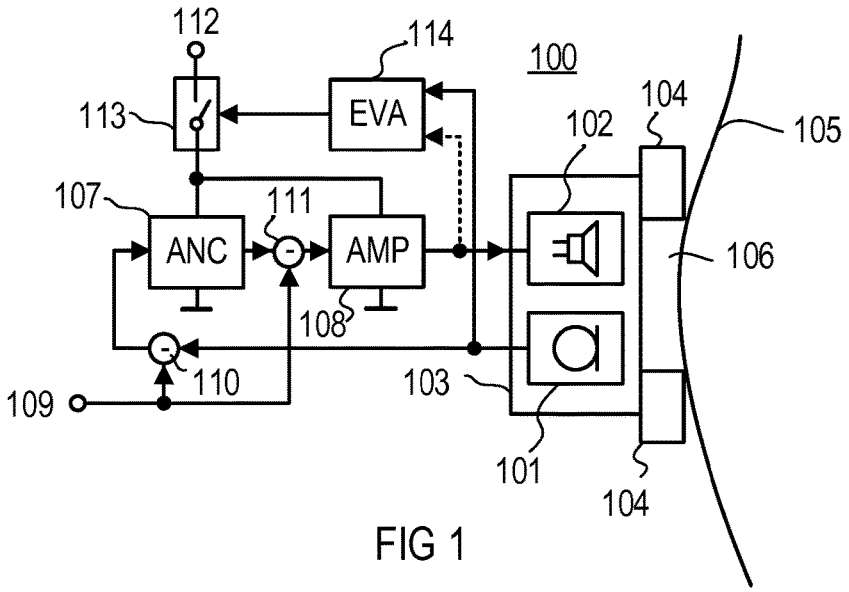
FIG. 1 is a block diagram illustrating an exemplary ANC headphone system with an automatic mode switch.

A Referring to FIG. 1, an exemplary ANC headphone system 100 may include two earpieces (for simplicity, FIG. 1 omits the second earpiece), each with a sensing microphone 101, which is located within close proximity to a loudspeaker 102. Microphone 101 and loudspeaker 102 are both located within a circumaural ear cup 103, which clamps to the side of user's head 105 with cushions 104, forming a closed cavity 106 with a limited volume system. Within enclosed cavity 106, sensing microphone 101 samples the present sound. The output of microphone 101 is fed to an ANC module 107, inverted in polarity and frequency-compensated to provide a signal that is fed through a driver amplifier 108 to loudspeaker 102 in order to broadcast sound that reduces acoustic noise present within cavity 106. Furthermore, a desired signal 109 (e.g., communication signals, musical signals, etc.) may be injected into ANC headphone system 100 in such a manner that desired signal 109 is not reduced but is rather faithfully reproduced. For example, desired signal 109 may be input to subtractor 110, which is connected between microphone 101 and ANC module 107, and/or to a subtractor 111, which is connected between ANC module 107 and driver amplifier 108. ANC module 107, driver amplifier 108 and other possible circuitry (not shown) are supplied with a supply voltage 112 via a controllable switch 113. Switch 113 is controlled by an evaluation module 114, which receives signals from microphone 101 and optionally also from loudspeaker 102.

Figure 2:
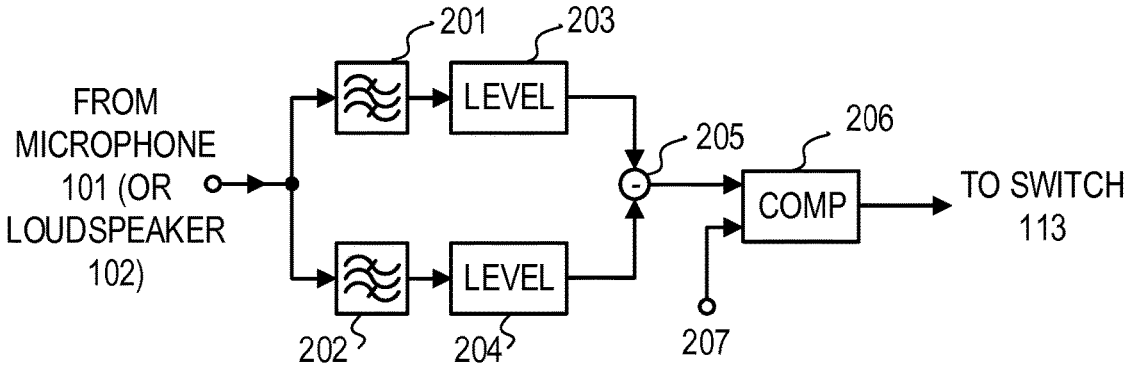
FIG. 2 is a block diagram illustrating an exemplary configuration of an evaluation module applicable in the ANC headphone system shown in FIG. 1.

An exemplary evaluation module 114 is shown in FIG. 2 and may include two band-limiting filters 201 and 202 (e.g. band-pass filters with narrow pass bands or peak filters) and subsequent level detectors 203 and 204. Filters 201 and 202 receive the signal output by microphone 101 and operate at different pass-band/peak frequencies (also herein referred to as evaluation frequencies), which may be within frequency ranges from 50 Hz to 300 Hz and/or from 300 Hz to 1,800 Hz. For example, one evaluation frequency may be 175 Hz or 200 Hz or something in between and the other may be 700 Hz or 1,000 Hz or something in between. In level detectors 203 and 204, the levels of the two evaluation signals are detected and fed into subtractor 205, which supplies a signal that represents the difference of the two evaluation signal levels to a comparator 206. Comparator 206 compares the signal from subtractor 205 with a reference value 207, which may be any value, including zero. For example, value 207 may be such that if the level at the higher evaluation frequency is higher than the level at the lower evaluation frequency by a certain value (e.g., 20 dB), comparator 206 outputs a signal to switch 113 indicating that the headphones are not being worn by the user and that control switch 113 should switch the mode, i.e. change the operating state of ANC module 107 and driver amplifier 108 (e.g., to change them into an off state in which no power is provided, into a standby state in which ANC module 107 and driver amplifier 108 only consume the minimum power necessary to be in an almost-on state, into a low-power state in which amplifier 108 is on and ANC module 107 is off or into any other reduced power state).

Figure 3:
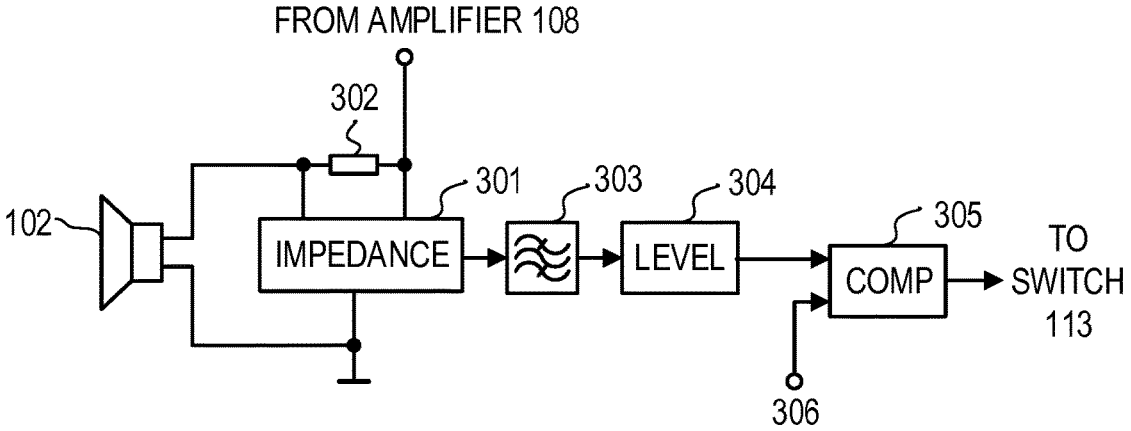
FIG. 3 is a block diagram illustrating an alternative or additional configuration of an evaluation module applicable in the ANC headphone system shown in FIG. 1.

Alternatively or additionally (e.g., in connection with an OR or AND operation of the outputs [not shown]), an exemplary evaluation module 114 may be used, as shown in FIG. 3. The evaluation module 114 shown in FIG. 3 includes an impedance evaluation module 301, which determines the momentary impedance over frequency of loudspeaker 102. The impedance of loudspeaker 102 may be calculated from the voltage over and the current through loudspeaker 102. The current flowing through loudspeaker 102 may be measured by way of a resistor 302 connected in series with loudspeaker 102, wherein the voltage over resistor 302 is representative of the current flowing through loudspeaker 102. The impedance over frequency of loudspeaker 102 is evaluated at a certain frequency (or narrowband frequency range) where the level difference is maximum between the operating modes when cavity 106 is closed and the related volume is thus limited (i.e., when the headphones are being worn by the user) or when cavity 106 is not closed and the related volume is thus unlimited (i.e., when the headphones are not being worn by the user). The level evaluation at the certain frequency may be performed by a peak frequency filter 303, is subsequent level detector 304 and comparator 305, which compares the signal output by level detector 304 with a reference value 306. For example, reference value 306 may be such that the impedance of loudspeaker 102 is above reference value 306 when the headphones are not being worn and below reference value 306 when the headphones are being worn.

Figure 4:
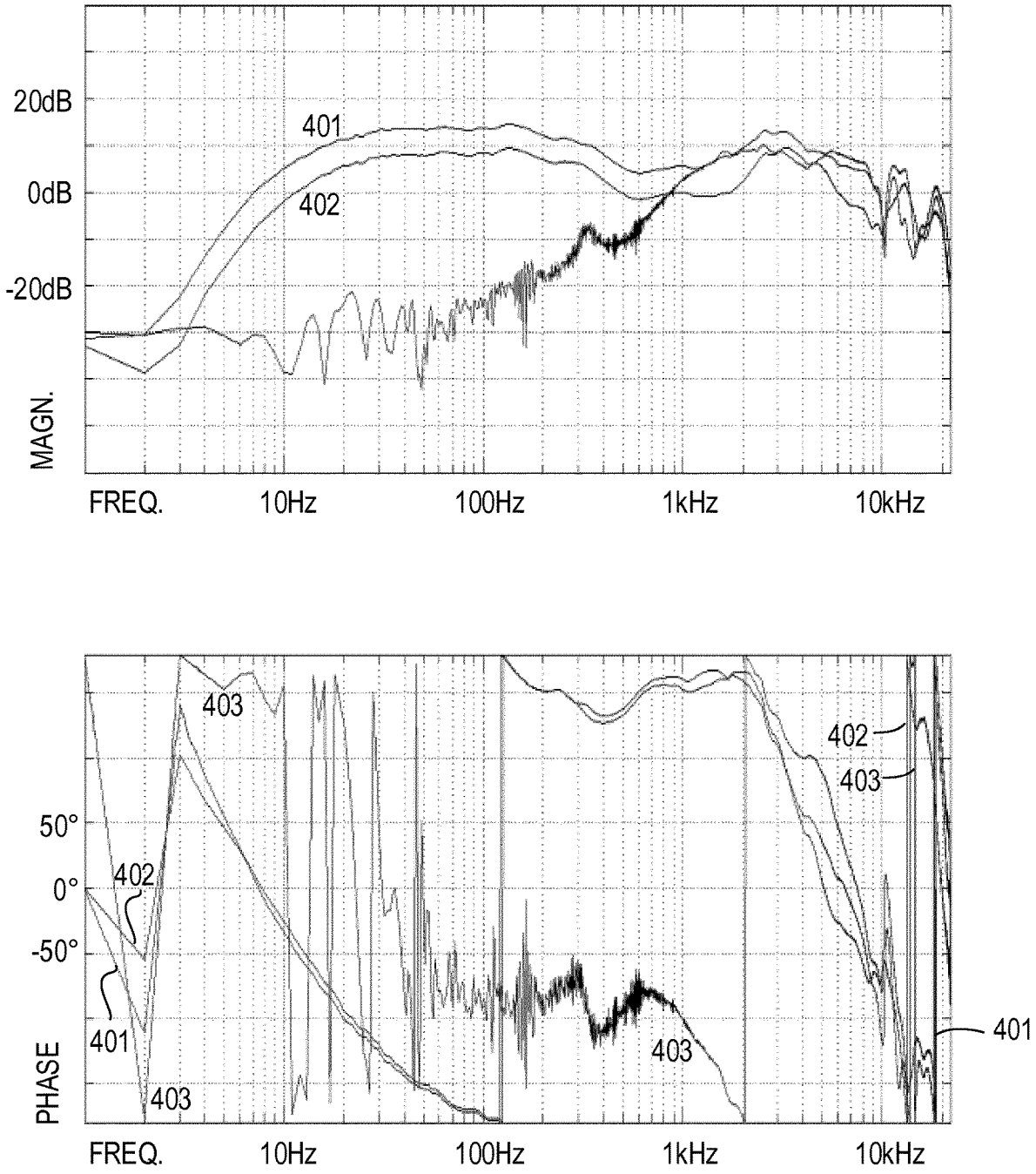
FIG. 4 is a diagram depicting magnitude and phase curves over frequency for a closed volume when the microphone is disposed within the ear cup, for a closed volume when the microphone is disposed within the ear canal and for an open volume.

Referring now to FIG. 4, ANC headphones are generally also able to reproduce desired signals related to all types of acoustic information besides noise-canceling sound such as speech, music, etc. Typically, the noise-canceling sound can be switched on and off in order for the headphones to be used as ANC headphones or ordinary headphones. Another option is to use the headphones only for noise-canceling purposes without reproducing any desired sound. The desired sound may be used to evaluate the so-called "secondary path", which is the acoustic path between a loudspeaker (such as loudspeaker 102) and an error microphone (such as microphone 101). For example, as shown in FIG. 1, after over-ear (circumaural) headphones are put on, ear cup 103, cushions 104 and user's head 105 define a substantially closed volume system (resulting in a pressure chamber effect) that changes when ear cup 103 is no longer engaged with user's head 105 (i.e., when the headphones are no longer being worn by the user). A pressure chamber can similarly be established with in-ear headphones. Due to the pressure chamber effect, loudspeaker 102 provides a significantly higher sound pressure level at lower frequencies (e.g., below 300 Hz) than it does without a pressure chamber, as can be seen from the Bode diagrams shown in FIG. 4. In this figure, graph 401 depicts magnitude and phase over frequency for a closed volume when microphone 101 is disposed within the ear cup, graph 402 depicts magnitude and phase over frequency for a closed volume when microphone 101 is disposed within the ear canal and graph 403 depicts magnitude and phase over frequency for an open volume.

In a headphone system corresponding to the exemplary Bode diagrams shown in FIG. 4, the lower evaluation frequency may be 200 Hz and the upper evaluation frequency may be 1,000 Hz. As can be seen, when the headphones are not being worn by a user, the level at 200 Hz undercuts the level at 1,000 Hz by more than 20 dB. If such a condition is present, for example, for more than 300 s, the headphone system may be controlled to change into a reduced power state. The evaluation frequencies and level differences may be chosen to operate satisfactorily with different users who may cause variations in the optimal evaluation frequencies and corresponding level differences due to their different head geometries and other factors such as glasses or hairstyles. To keep personal influences minimal, the lower evaluation frequency may be chosen to be higher than 150 Hz or the level difference may be chosen to be higher than 20 dB. When the desired signal is reproduced by the headphones, either the signal supplied to loudspeaker 102 (or a signal representative thereof) or the signal received from microphone 101 (or a signal representative thereof) may be used for evaluation. In this situation, the signal from microphone 101 corresponds to the signal broadcasted by loudspeaker 102.

However, there may be situations in which no desired signal is reproduced or the headphones are intended only to reduce noise without reproducing desired signals at all so that the acoustic conditions are different from the conditions described above in connection with FIG. 4. Absent a desired signal, only the signal from microphone 101 can be sufficiently evaluated; however, the pressure chamber effect still applies. Especially in the lower frequency range, ANC module 107 (e.g., a feedback ANC module) is still able to sufficiently reduce noise to form a pressure chamber when the volume system is closed (i.e., when the headphones are engaged with the user's head). In contrast, when the volume system is open (i.e., when the headphones are not engaged with the user's head), noise reduction deteriorates due to the fact that no sufficient counter-sound for canceling noise can be generated without the pressure chamber.

Figure 5:
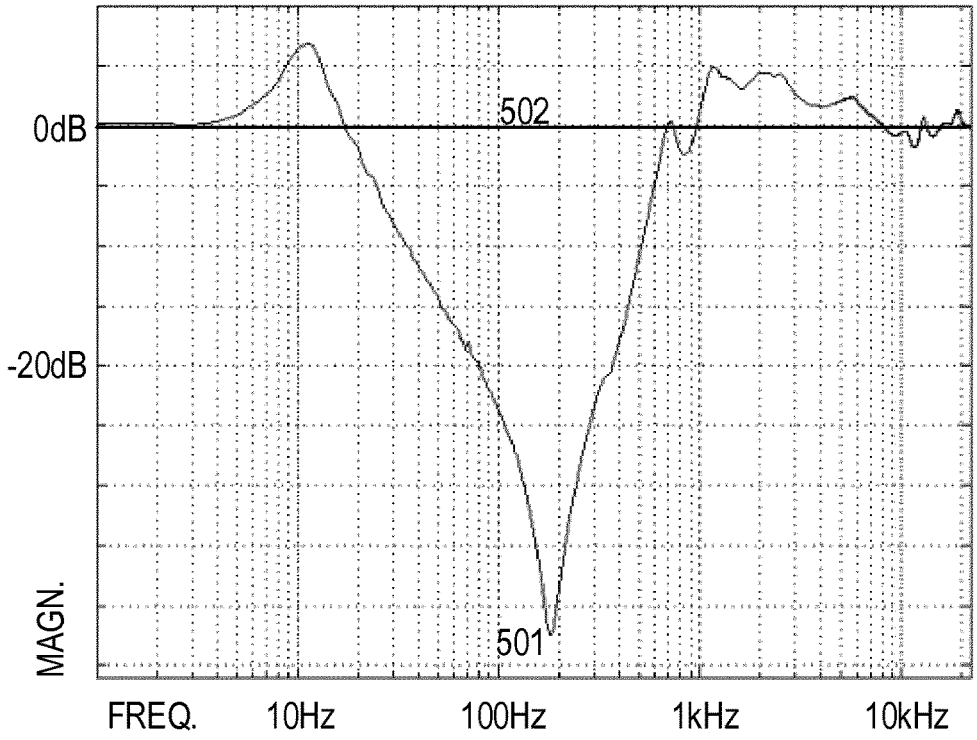
FIG. 5 is a diagram depicting the damping performance of an ANC module in the case of an active system coupled to a closed volume.
Figure 6:
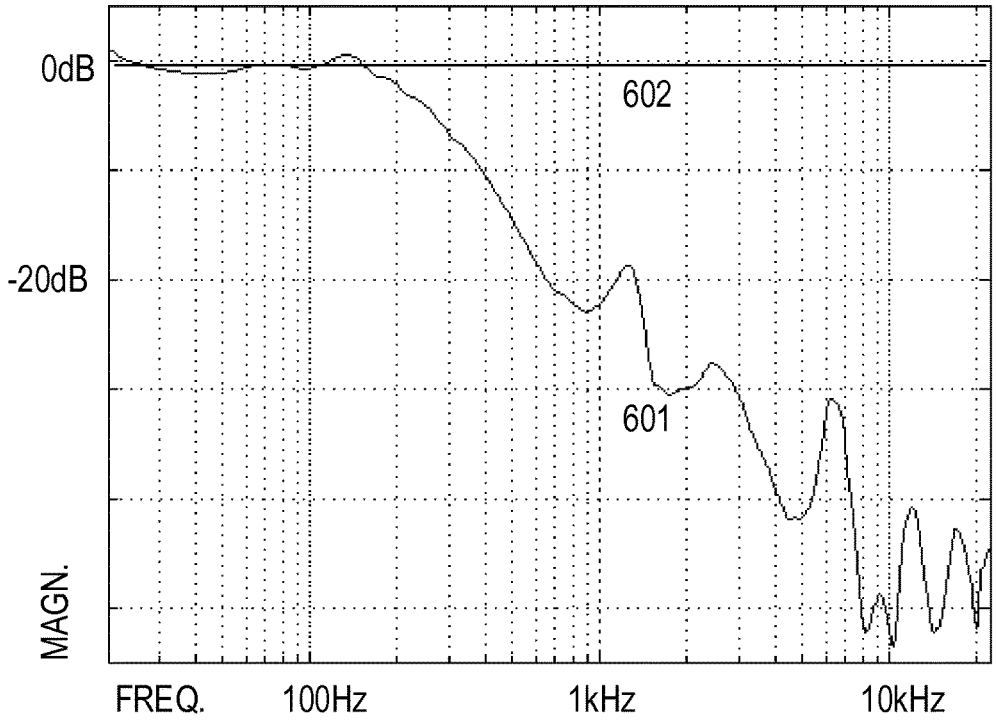
FIG. 6 is a diagram depicting the damping performance of a passive system coupled to a closed volume.

As can be seen from graph 501 in FIG. 5, in the case of an active system coupled to a closed volume (i.e., when the headphones are engaged with the user's head), the damping performance of an ANC module may have its maximum at around 175 Hz, where damping performance is still good, but poor performance results at frequencies below 20 Hz and above 700 Hz. In the case of a passive system (i.e., a system with no ANC and with damping only provided by passive damping components such as ear cups, cushions, etc.) coupled to a closed volume system, the performance is similar for frequencies between 20 Hz and 200 Hz, as can be seen from graph 601 in FIG. 6. In contrast, the active and passive systems exhibit almost no damping when the systems are coupled to open (unlimited) volume as can be seen from graphs 502 and 602 in FIG. 5 and FIG. 6, respectively. As can be further seen from FIG. 6, there is almost no damping below 200 Hz, even if the passive system is coupled to a closed volume. According to FIG. 4, active systems exhibit their peak performance particularly in the lower frequency range, where passive systems underperform. At higher frequencies, active systems perform well mainly because of their passive properties.

Comparator 206 compares the signal from subtractor 205 with a reference value 207, which may be any value, including zero. For example, value 207 may be such that if the level at the higher evaluation frequency is higher than the level at the lower evaluation frequency by a certain value (e.g., 20 dB), comparator 206 outputs a signal to switch 113 indicating that the headphones are not being worn by the user and that control switch 113 should change the operating state of ANC module 107 and driver amplifier 108 (e.g., to change them into an off state in which no power is provided, into a standby state in which ANC module 107 and driver amplifier 108 only consume the minimum power necessary to be in an almost-on state, into a low-power state in which amplifier 108 is on and ANC module 107 is off or into any other reduced power state).

Figure 7:
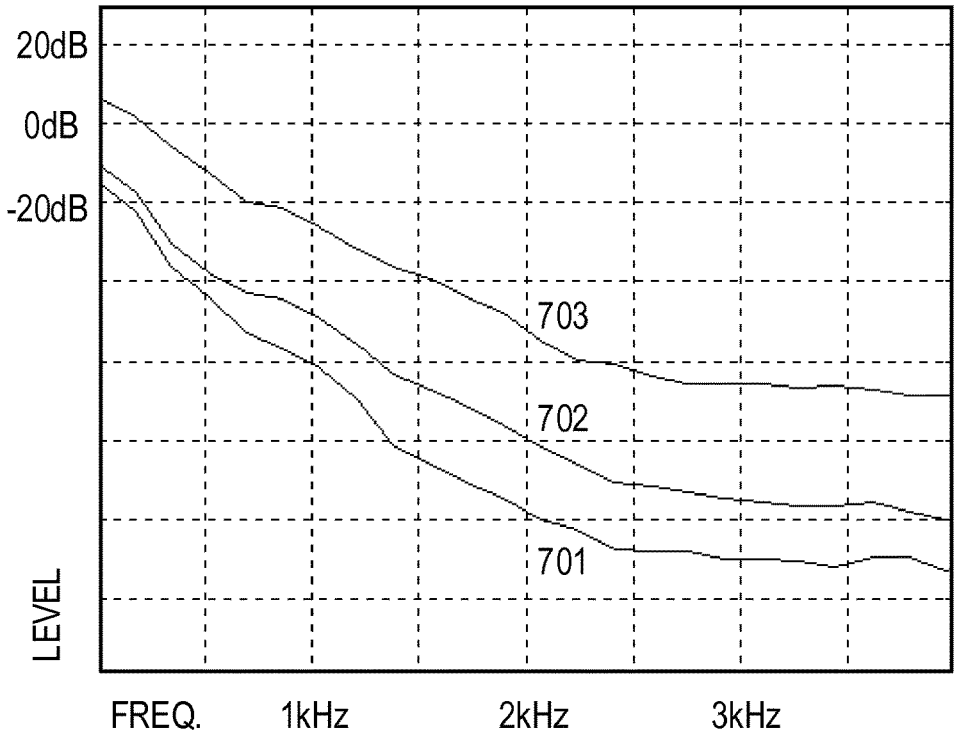
FIG. 7 is a diagram depicting the spectral distribution of different types of ambient noise.

If no desired signal is present, the active system still operates sufficiently since the ambient noise present at the headphones commonly has its peak performance at lower frequencies, as can be seen from FIG. 7. Different environments exhibit similar ambient noise behavior, as depicted by graphs 701-703, which show the levels of ambient noise typically present when driving in a city (graph 701), on a country road (graph 702) and on a highway (graph 703).

Figure 8:
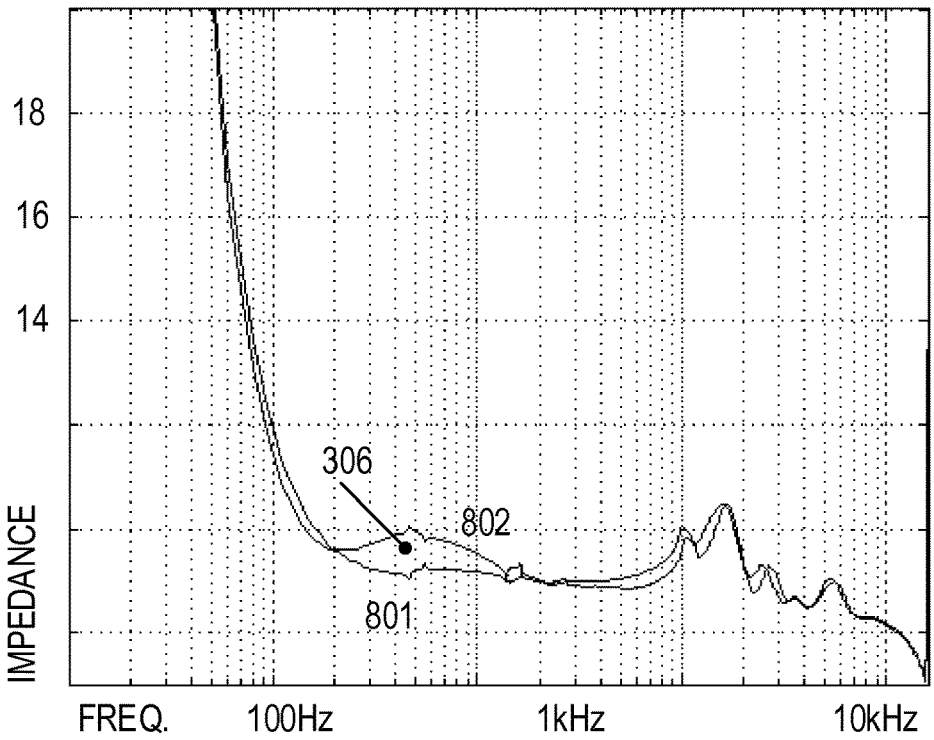
FIG. 8 is a diagram depicting the impedance over frequency for headphones coupled to a closed and an open volume.

As can be seen from FIG. 8, which shows the impedance curve over frequency of exemplary headphones when coupled to a closed volume (graph 801) and an open volume (graph 802), there is a difference between both impedance curves of around 45 Hz. This difference can be detected at this particular frequency, for example, by way of a comparator, such as comparator 305 shown in FIG. 3. Comparator 305 detects whether the measured impedance exceeds or undercuts reference value 306, which may be chosen to have a level between the two curves at the particular frequency (45 Hz).

Figure 9:
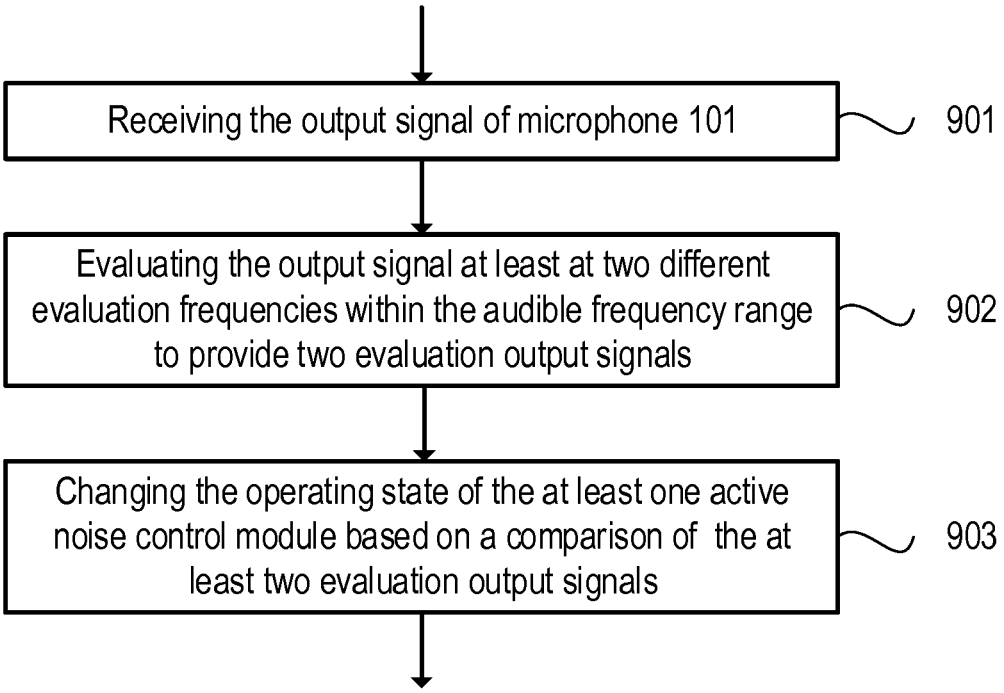
FIG. 9 is a flow chart illustrating an exemplary method for an automatic mode switch of an ANC headphone system.

An exemplary method for detecting the engagement and disengagement of headphones to or from the head of a user and for activating or deactivating the headphones, as shown in FIG. 9, may include receiving the output signal of microphone 101 (procedure 901), evaluating the output signal at at least two different evaluation frequencies within the audible frequency range to provide at least two evaluation output signals (procedure 902) and changing the operating state of the at least one active noise control module based on a comparison of the at least two evaluation output signals (procedure 903).

Figure 10:
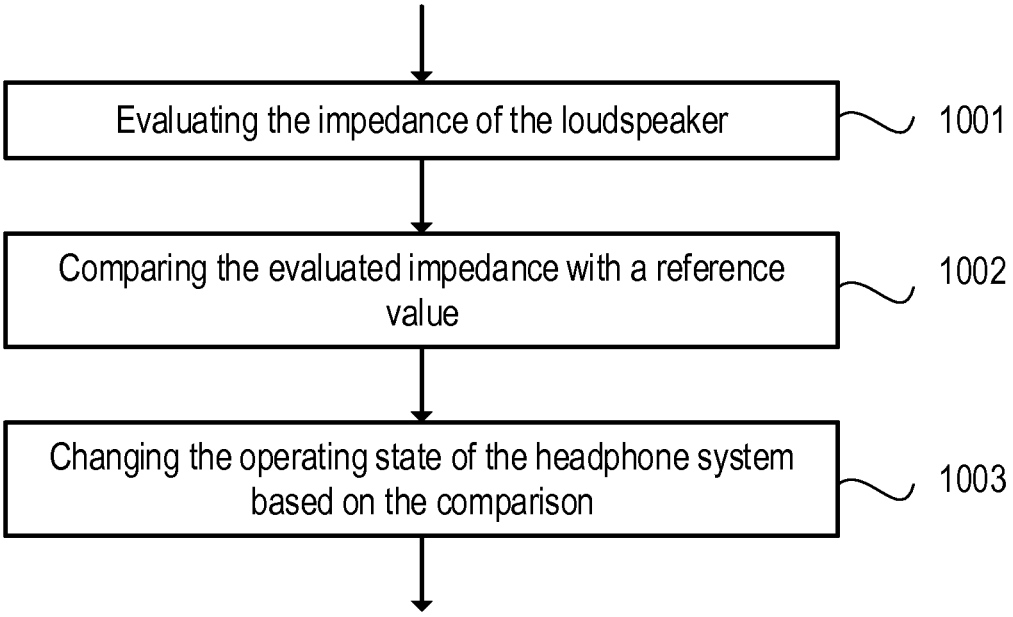
FIG. 10 is a flow chart illustrating an alternative or additional method for an automatic mode switch of an ANC headphone system.

An alternative or additional method for detecting the engagement and disengagement of headphones to or from the head of a user and for activating or deactivating the headphones, as shown in FIG. 10, may include evaluating the impedance of the loudspeaker at at least one evaluation frequency (procedure 1001), comparing the evaluated impedance with a reference value (procedure 1002) and changing the operating state of the headphone system based on the comparison (procedure 1003).

One exemplary embodiment provides an on-off switch for headphones that automatically detects the engagement and disengagement of headphones to or from the head of a user to activate or deactivate the headphone system. The on-off switch is especially useful to conserve battery life in battery-powered ANC headphone systems. However, the invention is generally applicable to automatically control the operational mode of any (active) headphones, including headsets, earphones or the like, regardless of the power source. Circuits and/or power sources (batteries, mains adaptors, etc.) may be integrated in the headphones or disposed separately from the headphones. For example, common feedback ANC headphones may already provide all the hardware necessary to automatically change the mode of operation, as described above, so that only minor modifications or additional software are required.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The invention claimed is:

1. An active noise control headphone system with power consumption control, the system comprising:

headphones with at least one ear cup and at least one loudspeaker disposed in the at least one ear cup;

at least one microphone disposed in or on the at least one ear cup that is configured to provide a microphone output signal representative of sound present in the at least one ear cup;

at least one active noise control module that has at least two operating states and that is connected upstream of the at least one loudspeaker and downstream of the at least one microphone, the at least one active noise control module being configured to provide a signal that when broadcasted, via the at least one loudspeaker, reduces noise;

a driver amplifier to drive the at least one loudspeaker; and an evaluation module including a first filter and a second filter, the evaluation module being configured to evaluate the microphone output signal at at least two different evaluation frequencies within an audible frequency range to provide at least two evaluation output signals and that is configured to change an operating state of the at least one active noise control module and the driver amplifier into a low power state in response to a comparison of the at least two evaluation output signals, wherein the low power state corresponds to:

the operating state of the at least one active noise control module being in an off-state; and the operating state of the driver amplifier being in an on-state.

2. The system of claim 1, wherein the at least two different evaluation frequencies comprise a lower evaluation frequency and a higher evaluation frequency;

the evaluation module is configured to evaluate the microphone output signal by comparing levels of the microphone output signal at the lower evaluation frequency and at the higher evaluation frequency; and the evaluation module is further configured to change the operating state of the at least one active noise control module to the off-state when the level of the microphone output signal at the lower evaluation frequency falls below the level of the microphone output signal at the higher evaluation frequency.

3. The system of claim 1, wherein one of the two different evaluation frequencies is within a frequency range from 50 Hz to 300 Hz and the other is within a frequency range from 300 Hz to 1,800 Hz.

4. The system of claim 1, wherein the evaluation module is further configured to change the operating state in response to a comparison result that occurs for a predetermined amount of time.

5. The system of claim 1, wherein:

the at least one ear cup engages a head of a user to define a limited volume acoustically coupled to the at least one loudspeaker when the user wears the headphones;

an unlimited volume is acoustically coupled to the at least one loudspeaker when the headphones are not being worn;

the at least one loudspeaker has an impedance that varies with the unlimited volume; and the evaluation module is further configured to evaluate the impedance of the at least one loudspeaker and to change an operating state of the active noise control headphone system based on the evaluation of the impedance.

6. The system of claim 5, wherein the impedance of the at least one loudspeaker is evaluated at a single frequency or a single frequency range.

7. The system of claim 5, wherein the evaluation of the impedance comprises a comparison of the impedance to a threshold.

8. A method for controlling a power consumption of an active noise control headphone system that comprises headphones with at least one ear cup; at least one loudspeaker disposed in the at least one ear cup; at least one microphone disposed in or on the at least one ear cup that is configured to provide a microphone output signal representative of sound present in the ear cup; and at least one active noise control module that has at least two operating states and that is connected upstream of the at least one loudspeaker and downstream of the at least one microphone, the at least one active noise control module being configured to provide a signal that when broadcasted, via the at least one loudspeaker, reduces noise; the method comprising:

evaluating the microphone output signal at at least two different evaluation frequencies within an audible frequency range to provide at least two evaluation output signals;

driving the at least one loudspeaker via a driver amplifier; and changing an operating state of the at least one active noise control module and the driver amplifier into a low power state in response to a comparison of the at least two evaluation output signals, wherein the low power state corresponds to:

the operating state of the at least one active noise control module being in an off-state; and the operating state of the driver amplifier being in an on-state.

9. The method of claim 8, wherein the at least two different evaluation frequencies comprise a lower evaluation frequency and a higher evaluation frequency; the method further comprising:

evaluating the microphone output signal by comparing levels of the microphone output signal at the lower evaluation frequency and the higher evaluation frequency; and changing the operating state of the at least one active noise control module to the off state when the level of the microphone output signal at the lower evaluation frequency falls below the level of the microphone output signal at the higher evaluation frequency.

10. The method of claim 8, wherein one of the two different evaluation frequencies is within a frequency range from 50 Hz to 300 Hz and the other is within a frequency range from 300 Hz to 1,800 Hz.

11. The method of claim 8, further comprising changing the operating state in response to a comparison result that occurs for a predetermined amount of time.

12. The method of claim 8, wherein the at least one ear cup engages a head of a user to define a limited volume acoustically coupled to the at least one loudspeaker when the user wears the headphones; an unlimited volume is acoustically coupled to the loudspeaker when the headphones are not being worn; and the at least one loudspeaker has an impedance that varies with the unlimited volume; the method comprising:

evaluating the impedance of the loudspeaker; and changing an operating state of a headphone system based on the impedance evaluation.

13. The method of claim 12, wherein the impedance of the at least one loudspeaker is evaluated at a single frequency or a single frequency range.

14. An active noise control headphone system with power consumption control, the system comprising:

headphones with at least one ear cup and at least one loudspeaker disposed in the at least one ear cup;

at least one microphone to provide a microphone output signal indicative of sound present in the at least one ear cup;

at least one active noise control module that has at least two operating states and that is connected to the at least one loudspeaker and the at least one microphone, the at least one active noise control module being configured to provide a signal that when broadcasted, via the at least one loudspeaker, reduces noise;

a driver amplifier to drive the at least one loudspeaker; and an evaluation module including a first filter and a second filter, the evaluation module being configured to evaluate the microphone output signal at at least two different evaluation frequencies within an audible frequency range to provide at least two evaluation output signals and that is configured to change an operating state of the at least one active noise control module and the driver amplifier into a low power state in response to a comparison of the at least two evaluation output signals, wherein the low power state corresponds to:

the operating state of the at least one active noise control module being in an off-state; and the operating state of the driver amplifier being in an on-state.

15. The system of claim 14, wherein the at least two different evaluation frequencies comprise a lower evaluation frequency and a higher evaluation frequency;

the evaluation module is configured to evaluate the microphone output signal by comparing levels of the microphone output signal at the lower evaluation frequency and at the higher evaluation frequency; and the evaluation module is further configured to change the operating state of the at least one active noise control module to the off-state when the level of the microphone output signal at the lower evaluation frequency falls below the level of the microphone output signal at the higher evaluation frequency by a given level difference.

16. The system of claim 14, wherein one of the two different evaluation frequencies is within a frequency range from 50 Hz to 300 Hz and the other is within a frequency range from 300 Hz to 1,800 Hz.

17. The system of claim 15, wherein:

the at least one ear cup engages a head of a user to define a limited volume acoustically coupled to the at least one loudspeaker when the user wears the headphones;

an unlimited volume is acoustically coupled to the at least one loudspeaker when the headphones are not being worn;

the at least one loudspeaker has an impedance that varies with the unlimited volume; and the evaluation module is further configured to evaluate the impedance of the at least one loudspeaker and to change an operating state of the headphone system based on the evaluation of the impedance.

* * * * *